US006158128A

United States Patent [19]

Huff

[11] Patent Number: 6,158,128

[45] Date of Patent: Dec. 12, 2000

[54] MEAT AND POULTRY SCISSORS

[76] Inventor: Bernard G. Huff, 160 Loch Lloyd Pkwy., Belton, Mo. 64012

[21] Appl. No.: 09/356,580

[22] Filed: Jul. 19, 1999

[51] Int. Cl.[7] ..... B26B 13/06; B26B 13/20

[52] U.S. Cl. ..... 30/254; 30/233; 30/257

[58] Field of Search ..... 30/233, 254, 256, 30/257; 452/3, 6, 102

[56] References Cited

U.S. PATENT DOCUMENTS

| | | | |
|---|---|---|---|
| D. 378,043 | 2/1997 | Ogura . | |
| 590,330 | 9/1897 | Nolen | 30/254 |
| 973,296 | 10/1910 | Peddle | 30/257 |
| 1,330,515 | 2/1920 | Bryant | 30/257 |
| 2,038,916 | 4/1936 | Vorwerk | 30/254 |
| 2,370,026 | 2/1945 | Elia | 30/254 |
| 3,084,433 | 4/1963 | Kimmel | 30/254 |
| 3,825,020 | 7/1974 | Myers | 30/254 |
| 3,869,792 | 3/1975 | Laurenti | 30/254 |
| 3,987,542 | 10/1976 | Visco | 30/257 |
| 4,635,363 | 1/1987 | Chapin | 30/257 |
| 5,108,343 | 4/1992 | Gilliam | 30/254 |
| 5,341,573 | 8/1994 | Linden et al. | 30/254 |
| 5,720,103 | 2/1998 | West et al. . | |

OTHER PUBLICATIONS

Wolff Industries, Inc. Catalog (Jan., 1996).

Photographs of prior art processsing shears sold under the designation "ERGONOMIX" by Wolff Industries, Inc. (marked as Exhibit A).

*Primary Examiner*—Hwei-Siu Payer

*Attorney, Agent, or Firm*—Hovey, Williams, Timmons & Collins

[57] ABSTRACT

Meat and poultry scissors are disclosed as including a pair of swingably interconnected blades fixed to respective thumb and finger handles. The blades are flat and the thumb handle presents a thumb-receiving opening defined about an axis that is oblique relative to the respective blade, while the finger handle presents a finger-receiving opening defined about an axis that is perpendicular to the respective blade. In addition, the blades are different lengths, with the longer blade having a blunt outermost, distal end and a cutting edge that is spaced from the distal end. The end of the shorter blade presents an outermost distal end that is spaced generally the same distance from the end of the long blade as the cutting edge of the long blade.

9 Claims, 2 Drawing Sheets

MEAT AND POULTRY SCISSORS

BACKGROUND OF THE INVENTION

1. Field of the Invention

The present invention relates generally to utensils and tools used in meat and poultry processing plants. More particularly, the present invention concerns meat and poultry scissors, wherein the scissors are configured to avoid puncturing of the carcass during use and the gripping portion of the scissors prevents the discomfort normally associated with prolonged use of conventional scissors.

2. Discussion of Prior Art

Those ordinarily skilled in the art will appreciate that meat and poultry processing often requires the animal or bird carcass to be cut or divided. It is also known to use scissors to assist workers with cutting or shearing of the carcass. However, conventional meat and poultry scissors present numerous problems. For example, conventional scissors become uncomfortable after prolonged use and may even cause repetitive motion disorders. In addition, if not properly handled, traditional scissors can cause inadvertent and unwanted punctures of the carcass. Such puncturing might cause contaminants, such as stomach or intestine contents, to damage the carcass.

OBJECTS AND SUMMARY OF THE INVENTION

Responsive to these and other problems, an important object of the present invention is to provide meat and poultry scissors that are highly effective in facilitating cutting and shearing of an animal or bird carcass. Another important object of the present invention is to provide meat and poultry scissors that are durable yet inexpensive. It is particularly an important object of the present invention to provide meat and poultry scissors having a comfortable grip. That is, an important object of the present invention is to provide meat and poultry scissors that do not cause discomfort during prolonged use. Yet another important object of the present invention is to provide meat and poultry scissors that reduce the risk of inadvertent puncturing of the carcass.

In accordance with these and other objects evident from the following description of the preferred embodiment, the present invention concerns meat and poultry scissors having highly comfortable thumb and finger handles for controlling swinging movement of the blades. The thumb handle presents a thumb-receiving opening that is defined about an axis that is oblique relative to the axis about which the finger-receiving opening of the finger handle is defined. It has been determined that such a handle arrangement conforms to the natural position of the hand of the user during operation of the scissors. In addition, the forces exerted against the thumb by the thumb handle are distributed over a greater area than the two distinct pressure points normally associated with traditional scissors. The blades of the scissors are of different lengths, with the longer blade including a blunt, outermost distal end and a cutting edge that is spaced from the blunt distal end. When the scissors are closed, the distal end of the shorter blade and the cutting edge of the longer blade are spaced the same distance from the distal end of the longer blade. It is believed that this inventive blade design virtually eliminates the risk of inadvertent puncturing of the carcass by the ends of the blades.

Other aspects and advantages of the present invention will be apparent from the following detailed description of the preferred embodiments and the accompanying drawing figures.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

The meat and poultry scissors 20 selected for illustration generally include relatively swingable first and second blades 22 and 24 and thumb and finger handles 26 and 28 for permitting single-handed control of swinging of the blades 22 and 24. Although the illustrated scissors 20 have an overall appearance that is similar to conventional scissors, the blades 22 and 24 are uniquely designed to prevent undesirable puncturing of the carcass and the handles 26 and 28 provide unprecedented comfort, as will subsequently be described.

Figure 1:
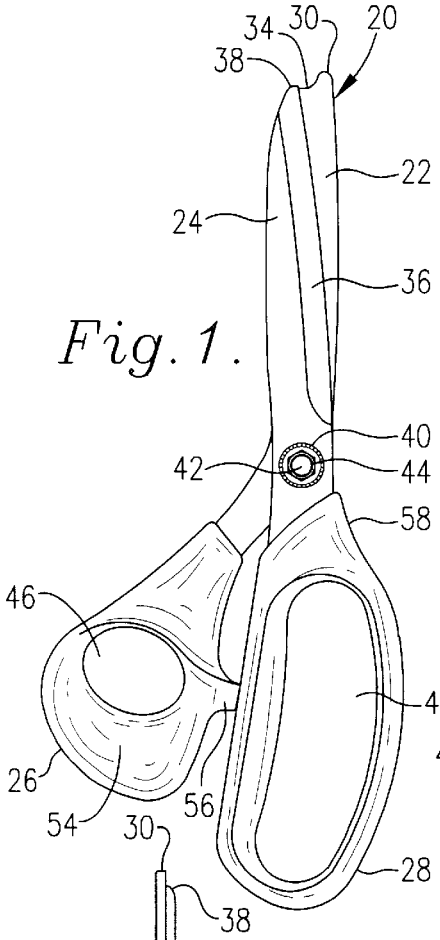
FIG. 1 is a top plan view of meat and poultry scissors constructed in accordance with the principles of the present invention.
Figure 2:
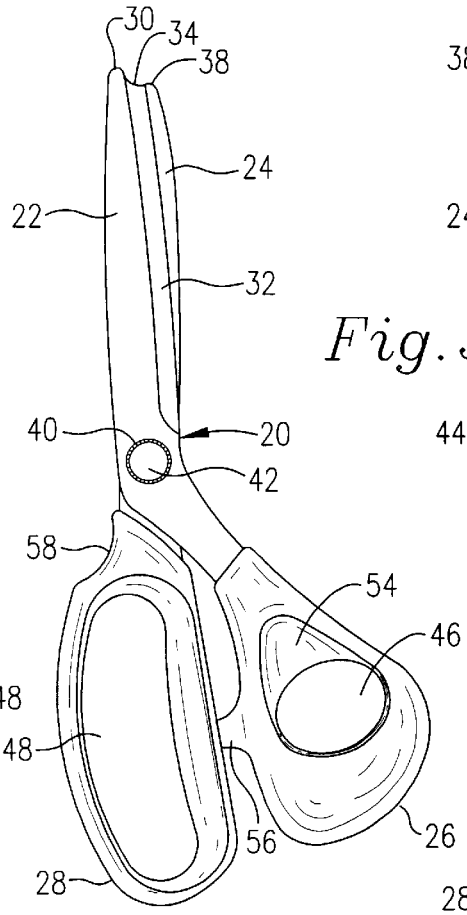
FIG. 2 is a bottom plan view of the scissors.
Figure 3:
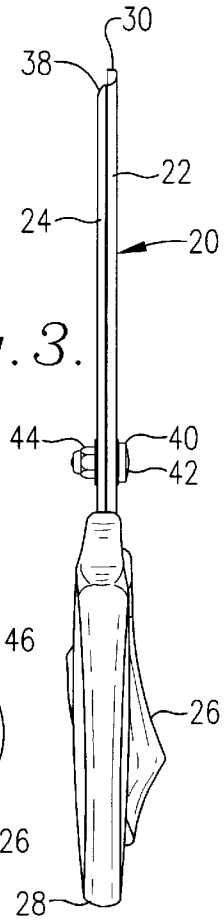
FIG. 3 is a side elevational view of the scissors.
Figure 9:
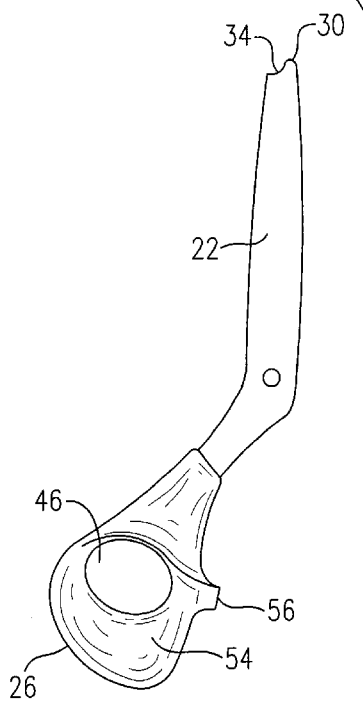
FIG. 9 is a top plan view of just the thumb handle and associated blade.
Figure 10:
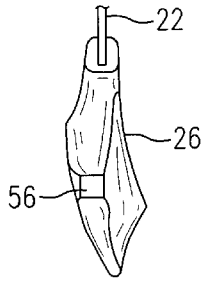
FIG. 10 is a fragmentary side elevational view of the thumb handle.
Figure 8:
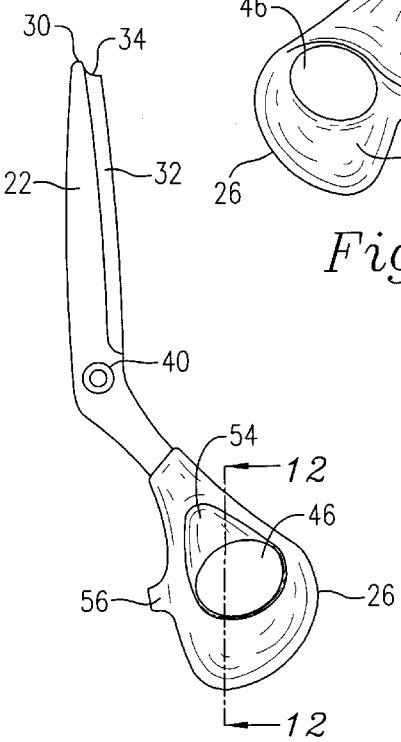
FIG. 8 is a bottom plan view of just the thumb handle and associated blade.

It is first noted that the blades 22 and 24 are flat and disposed alongside one another such that the cutting portion of the scissors 20 is generally planer. The first blade 22 is longer than the second blade 24, and the tip of the scissors 20, when the scissors are closed, is consequently defined by the end 30 of the first blade 22 (e.g., see FIG. 3). The end 30 of the first blade 22 is blunt and preferably has an arcuate or rounded profile. Extending along the length of the first blade 22 is a beveled cutting edge 32 that tapers toward the second blade 24. It is particularly noted that the cutting edge 32 terminates short of the blunt end 30 and that a small, somewhat concave face 34 extends between the blunt end 30 and cutting edge 32. In addition, the blunt end 30 is defined generally at one side of the blade 22 while the cutting edge extends along the opposite side. As perhaps best shown in FIGS. 8–9, the first blade 22 presents a so-called "dog leg" shape, with the relatively angled portions of the illustrated blade 22 defining an interior angle of approximately 135° therebetween. On the other hand, the second or shorter blade 24 is generally straight. Furthermore, the second blade 24 includes a cutting edge 36 that tapers toward the first blade 22 and projects from the distal end 38 of the blade 24. The blades 22 and 24 are arranged so that the distal end 38 of the second blade 24 is adjacent the outermost end of the cutting edge 32 of the first blade 22, when the scissors 20 are closed (e.g., see FIGS. 1 and 2). In other words, the cutting edge 32 of the first blade 22 and the distal end 38 of the second blade 24 are spaced generally the same distance from the tip of the scissors 20 (i.e., the end 30 of the first blade), when the scissors 20 are closed. The cutting edges 32 and 36 are generally coextensive and, in the usual manner, are designed to effect a shearing action as the blades 22 and 24 are moved toward one another. The blades 22 and 24 are preferably formed of stainless steel, although other suitable materials may be used.

Figure 7:
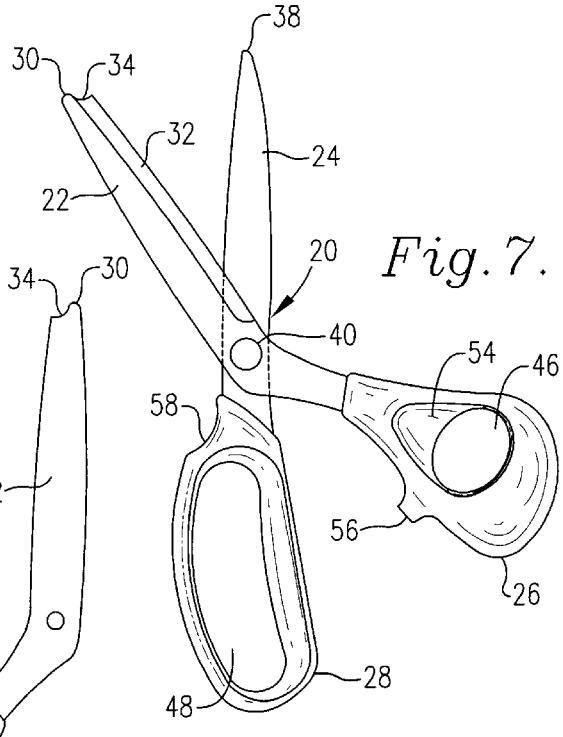
FIG. 7 is a bottom plan view of the scissors similar to FIG. 2, but illustrating the pivot fastener schematically and the blades being swung apart into an open condition.

In the illustrated embodiment, the blades 22 and 24 are swingably interconnected by a pivot fastener 40. The fastener 40 preferably comprises a screw 42 projecting through the blades 22 and 24 and a locknut 44 threadably connected to the screw 42, although other suitable fasteners may be used. It is noted that the blades 22 and 24 project in opposite directions from the fastener 40, with the fastener 40 being located generally at the juncture between the relative angled portions of the first blade 22. Again, the fastener 40 permits relative swinging movement of the blades 22 and 24 so that the scissors may be opened (e.g., see FIG. 7) and closed (e.g., see FIGS. 1 and 2).

The handles 26 and 28 are fixed to the blades 22 and 24, respectively, and are therefore relatively swingable. It may also be said that movement of the thumb handle 26 causes corresponding movement of the first blade 22 and movement of the finger handle 28 causes corresponding movement of the second blade 24. The handles 26 and 28 are preferably formed of an elastomeric material which is molded into the desired shape directly on the proximal ends of the blades 22 and 24. In the illustrated embodiment, the handles 26 and 28 consequently overlie and cover a portion of the respective blades 22 and 24. Although not shown, it is noted that these portions of the blades 22 and 24 are preferably fork-shaped so as to ensure sufficient "adhesive" contact with the handles 26 and 28 yet prevent the blades 22 and 24 from excessively rigidifying the handles. A suitable handle material is sold under the designation "SANTOPRANE #101-87". Those ordinarily skilled in the art will appreciate that this arrangement, along the with the use of the preferred elastomeric material (or a suitable alternative) to form the handles 26 and 28, causes the handles 26 and 28 to be slightly flexible and relatively soft when gripped. In addition, the preferred handle material significantly reduces the risk of slippage from the user's hand, which is particularly useful in wet operating conditions.

Figure 4:
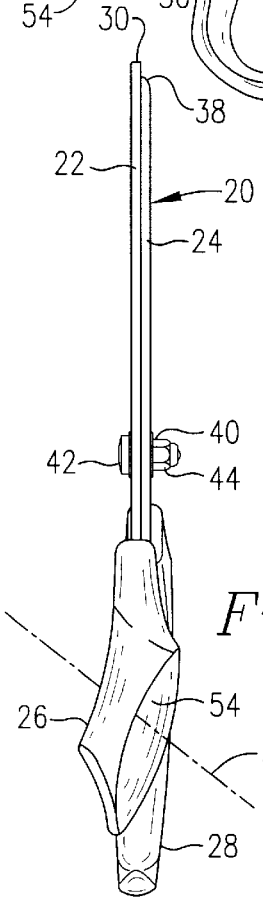
FIG. 4 is an elevational view of the side of the scissors opposite that shown in FIG. 3.
Figure 5:
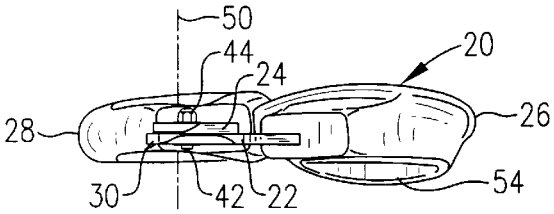
FIG. 5 is an end elevational view of the scissors.
Figure 6:
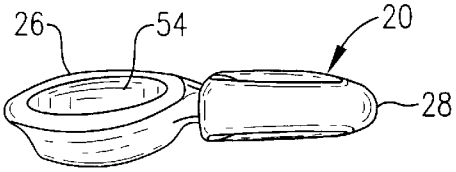
FIG. 6 is an elevational view of the end of the scissors opposite that shown in FIG. 5.
Figure 11:
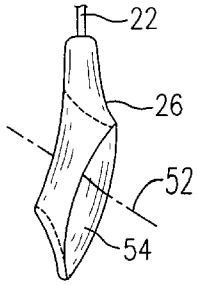
FIG. 11 is a fragmentary elevational view of the side of the thumb handle opposite that shown in FIG. 10.
Figure 12:
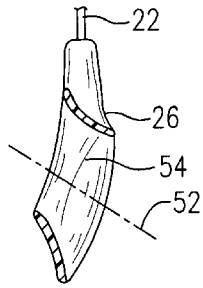
FIG. 12 is a fragmentary cross-sectional view of the thumb handle taken along line 12—12 in FIG. 8.

The handles 26 and 28 are uniquely configured to further improve comfort of the scissors 20 over traditional scissors designs. It is initially noted that the illustrated scissors 20 are designed for use by the right hand, however, the principles of the present invention are equally applicable to "left-handed" scissors. The thumb handle 26 presents an opening 46 configured to receive the right thumb of the user, while the finger handler 28 presents an opening 48 configured to receive all of the right fingers of the user. It will be appreciated that the handles 26 and 28 cause the user to grip and operate the scissors 20 with the right hand in a natural orientation. This is believed to dramatically improve comfort and thereby reduce the risk of user fatigue and injury often associated with prolonged usage of traditional scissors. It is particularly noted that the finger-receiving opening 48 is generally defined about an axis 50 (see FIG. 5) that is substantially perpendicular to the second blade 24 and the thumb-receiving opening 46 is generally defined about an axis 52 (see FIGS. 4, 11 and 12) that is oblique relative to the first blade 22 and consequently also the axis 50. Preferably, the axis 52 of the thumb-receiving opening 46 slopes away from the first blade 22 at an angle of approximately 128°.

The illustrated thumb handle 26 is generally teardrop-shaped, and the thumb-receiving opening is defined by an interior surface 54 that flares outwardly toward the end of the handle opposite from the first blade 22, whereby the thumb-receiving opening 46 converges slightly in the direction of thumb insertion. Those ordinarily skilled in the art will appreciate that the interior surface 54 consequently conforms generally to the shape of the right thumb (adjacent the proximal joint of the thumb). The thumb handle 26 further includes a stop projection 56 configured to abuttingly engage the outer surface of the finger handle 58 when the scissors 20 are closed, such that movement of the blades 22 and 24 beyond the closed condition of the scissors 20 is prevented. On the other hand, the finger handle 28 is oblong so that the finger-receiving opening 48 has a generally elliptical shape (e.g., see FIGS. 1 and 2). The preferred opening 48 is approximately 3.25 inches long, as it is believed that this size will accommodate the fingers of most adult hands. Adjacent the second blade 24 is a concave face 58, upon which the index finger of the user may be placed during use.

As noted above, certain features of the handles 26 and 28 provide relatively improved comfort and operation over traditional scissors designs. However, it is entirely within the ambit of the present invention to employ various other handle constructions. For example, the handles and blades could be formed of a unitary, single piece of material, if desired.

In operation, the user inserts his/her right thumb into the thumb-receiving opening 46 and the fingers of the same hand into the finger-receiving opening 48. As noted, all of the user's fingers may be placed within the finger-receiving opening 48, which permits the user to exert a greater closing force than if the finger handle was designed to receive only one or two of the user's fingers. If necessary, the index finger may be placed on the concave face 58 of the finger handle 28. When the scissors 20 are gripped, the user's hand is in its natural orientation and this orientation is maintained as the scissors 20 are operated (i.e., as the handles 26 and 28 are swung toward and away from one another). It is also noted that the unique shape of the interior surface 54 of the thumb handle 26 causes the forces exerted against the thumb to be distributed over a relatively large area, rather than at two distinct contact points defined between the thumb and thumb handle as is common with traditional scissors designs. Additionally, the inventive scissors 20 significantly reduce the risk of inadvertent carcass puncturing and injury to the user. This is not only attributable to the improved grip provided by the handles 26 and 28 but also to the blade design, wherein the tip of the scissors 20 is defined by the blunt outermost end 30 of the longer blade 22 and the cutting edge 32 of the longer blade 22 and the end 38 of the shorter blade 24 are spaced generally the same distance from the blunt end 30.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. Meat and poultry scissors comprising:

a pair of substantially flat first and second blades that are swingable relative to one another;

a thumb handle operably coupled to the first blade for permitting manual control of swinging of the first blade, said thumb handle presenting a thumb-receiving opening defined about a first axis that is oblique relative to the first blade; and a finger handle operably coupled to the second blade for permitting manual control of swinging of the second blade, said finger handle presenting a finger-receiving opening defined about a second axis that is generally perpendicular to the second blade, said first blade being longer than the second blade, said first blade including a blunt, outermost first distal end and a first cutting edge that extends along the length of the first blade but terminates short of the first distal end so that the first cutting edge is spaced from the first distal end.

2. Meat and poultry scissors as claimed in claim 1, said finger-receiving opening being configured to receive all of the fingers of the user.

3. Meat and poultry scissors as claimed in claim 1; and a pivot fastener swingably interconnecting the first and second blades, said handles being fixed to respective ones of the blades for swinging movement therewith.

4. Meat and poultry scissors as claimed in claim 1, said second blade including an outermost second distal end that is spaced generally the same distance from the first distal end as the first cutting edge when the scissors are closed.

5. Meat and poultry scissors comprising:

a pair of blades that are swingable relative to one another; and a finger handle and a thumb handle operably coupled to respective ones of the blades for permitting manual control of swinging of the blades, said finger handle presenting a finger-receiving opening defined about a second axis that is oblique relative to the first axis, one of said blades being longer than the other said one blade including a blunt, outermost distal end and a cutting edge that extends along the length of the one blade but terminates short of the distal end so that the cutting edge is spaced from the distal end.

6. Meat and poultry scissors as claimed in claim 5, said blades being substantially flat, said first axis being generally perpendicular to the blades.

7. Meat and poultry scissors comprising:

a pair of handles that are swingable relative to one another to permit manual operation of the scissors; and a pair of elongated first and second blades operably coupled to the handles so that swinging movement of the handles effects swinging movement of the blades, said first blade including a blunt, outermost first distal end and a first cutting edge that extends along the length of the first blade but terminates short of the first distal end so that the first cutting edge is spaced from the first distal end, said second blade being shorter than the first blade such that the second blade presents an outermost second distal end that is spaced from the first distal end when the scissors are closed, said second distal end and said first cutting edge being spaced generally the same distance from the first distal end when the scissors are closed.

8. Meat and poultry scissors as claimed in claim 7, said second blade including a second cutting edge that projects from the second distal end, said first cutting edge and said second cutting edge being substantially coextensive.

9. Meat and poultry scissors as claimed in claim 7, said first distal end being rounded.

* * * * *